US010458312B2

(12) United States Patent
Wang et al.

(10) Patent No.: US 10,458,312 B2
(45) Date of Patent: Oct. 29, 2019

(54) SYSTEMS AND METHODS FOR CONTROLLING ENRICHED PRECHAMBER STOICHIOMETRY

(71) Applicant: Caterpillar Inc., Peoria, IL (US)

(72) Inventors: Paul Wang, Peoria, IL (US); David Ginter, Commerce Township, MI (US); Jaswinder Singh, Dunlap, IL (US); Arnold Kim, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 173 days.

(21) Appl. No.: 15/656,944

(22) Filed: Jul. 21, 2017

(65) Prior Publication Data

US 2019/0024571 A1 Jan. 24, 2019

(51) Int. Cl.
*F02B 19/12* (2006.01)
*F02B 19/10* (2006.01)
*F02D 41/30* (2006.01)

(52) U.S. Cl.
CPC ..... *F02B 19/1085* (2013.01); *F02B 19/12* (2013.01); *F02D 41/30* (2013.01)

(58) Field of Classification Search
CPC ..... F02B 19/1085; F02B 19/12; F02D 41/30
USPC ..... 123/260; 701/109; 73/35.07, 114.72, 73/114.73
See application file for complete search history.

(56) References Cited

U.S. PATENT DOCUMENTS 5,791,145 A 8/1998 Freen
7,100,567 B1 * 9/2006 Bailey ..... F02B 19/06 123/268
8,215,284 B2 7/2012 Suzuki et al.
8,925,518 B1 * 1/2015 Riley ..... F02B 19/10 123/261
10,161,296 B2 * 12/2018 Schock ..... F02B 19/12
10,208,651 B2 * 2/2019 Tozzi ..... F02B 19/08
2006/0219210 A1 * 10/2006 Bailey ..... F02B 19/06 123/259
2014/0144406 A1 * 5/2014 Schock ..... F02B 19/12 123/260
2015/0059456 A1 3/2015 Niessner et al.
2017/0101948 A1 4/2017 Kunkel

FOREIGN PATENT DOCUMENTS

DE 3331114 3/1985
DE 202013102541 U1 8/2013
DE 2013 210 965 * 4/2014 ..... F02D 41/02
DE 102013210965 9/2014

(Continued)

OTHER PUBLICATIONS

Yeager, Mary Louise, "Control System for an Engine Cylinder", U.S. Appl. No. 15/296,181, filed Oct. 18, 2016.

*Primary Examiner* — Hai H Huynh
(74) *Attorney, Agent, or Firm* — Jonathan F. Yates

(57) ABSTRACT

A system for controlling enriched prechamber stoichiometry includes a prechamber ignition device, and an ignition control system that includes a sensor structured to measure an amount of at least one of CO2 or O2 in a prechamber, an engine timing sensor, a fuel quality sensor, and an electronic control unit. The electronic control unit is structured to receive signals from each of the sensors and determine an air-fuel ratio of the prechamber for comparison with a target air-fuel ratio, and produce a fuel delivery signal based on the comparison.

19 Claims, 2 Drawing Sheets

(56) References Cited

FOREIGN PATENT DOCUMENTS

| | | |
|---|---|---|
| DE | 102013210966 | 12/2014 |
| DE | 102014207272 | 10/2015 |
| JP | 2001248445 | 9/2001 |
| JP | 2008248750 | 10/2008 |

* cited by examiner

SYSTEMS AND METHODS FOR CONTROLLING ENRICHED PRECHAMBER STOICHIOMETRY

TECHNICAL FIELD

The present disclosure relates generally to an ignition control system for an engine and, more particularly, to systems and methods for controlling stoichiometry of a prechamber ignition device in an engine.

BACKGROUND

The use of an auxiliary combustion chamber device, often referred to as a prechamber device or a prechamber ignition device, in an engine to control ignition and improve fuel utilization or otherwise improve or affect performance is well known in the art. Prechamber devices generally include an auxiliary combustion chamber (i.e., a combustion prechamber or a prechamber) for combusting a mixture of air and fuel. Combustion in the prechamber is frequently spark-initiated by a sparkplug or the like. The resulting combustion gases expand rapidly, eventually escaping the prechamber through ignition outlets formed therein, and into a primary combustion chamber, providing a hotter, more uniform ignition catalyst to a main charge of fuel and air than an igniter could provide alone.

In comparison to other ignition strategies, the reliability and effectiveness of spark-ignition can be more reliant on fuel quality and the uniformity of the air-fuel mixture. For example, fuels such as natural gas may experience ignition problems or unstable combustion, especially in lean mixtures, due to variations in fuel quality. These and other issues may negatively impact ignition and combustion in both the prechamber and the primary combustion chamber, possibly causing issues such as unreliable ignition timing, ignition failure, engine knock, increased exhaust emissions such as NOx, decreased thermal efficiency, and overall reductions in engine performance.

Attempts have been made to combat these and similar issues by adjusting fuel and/or air delivery to the prechamber. One such strategy is set forth in U.S. patent application Ser. No. 15/296,181 to Yeager ("Yeager"), now U.S. Pat. No. 9,903,264. Yeager proposes a control system for an engine cylinder structured to adjust fuel delivery responsive to the relative pressure ratios in a prechamber and a main combustion chamber. The system utilizes pressure sensors positioned in both the prechamber and the main combustion chamber. A processor apparently generates a signal to alter delivery of fuel to the prechamber or the combustion chamber based on a difference in the pressures. Improved or alternative strategies for determining variations in prechamber combustion properties, and making adjustments to various ends remain desirable in some applications.

SUMMARY OF THE INVENTION

In one aspect, an ignition control system for an internal combustion engine includes a sensor structured to measure at least one of CO2 or O2 in a combustion prechamber of a prechamber ignition device, and an electronic control unit. The electronic control unit is structured to receive data indicative of an amount of the at least one of CO2 or O2, determine an air-fuel ratio of the prechamber that is associated with production of the amount of the at least one of CO2 or O2, and output a fuel delivery signal to adjust air-fuel ratio in the combustion prechamber towards a target air-fuel ratio.

In another aspect, a method of adjusting the stoichiometry of a combustion prechamber in an internal combustion engine includes producing data indicative of an amount of at least one of CO2 or O2 produced by combustion of a first charge of air and fuel in a combustion prechamber, outputting a fuel delivery signal to vary an amount of fuel delivered to the combustion prechamber after the combustion of the first charge of air and fuel, and igniting a second charge of fuel and air in the combustion prechamber that has an amount of fuel that is based on the fuel delivery signal.

In still another aspect, an internal combustion engine includes an engine block, a cylinder formed in the engine block, a piston disposed in the cylinder, the piston and the cylinder defining a combustion chamber, a prechamber ignition device having a combustion chamber, and an ignition control system. The ignition control system includes a prechamber sensor structured to measure at least one of CO2 or O2, an engine timing sensor, a fuel supply system structured to deliver a fuel to the combustion prechamber, and an electronic control unit. The electronic control unit is structured to control an air-fuel ratio in the combustion prechamber based at least in part on data received by the prechamber sensor and the engine timing sensor.

DETAILED DESCRIPTION

Figure 1:
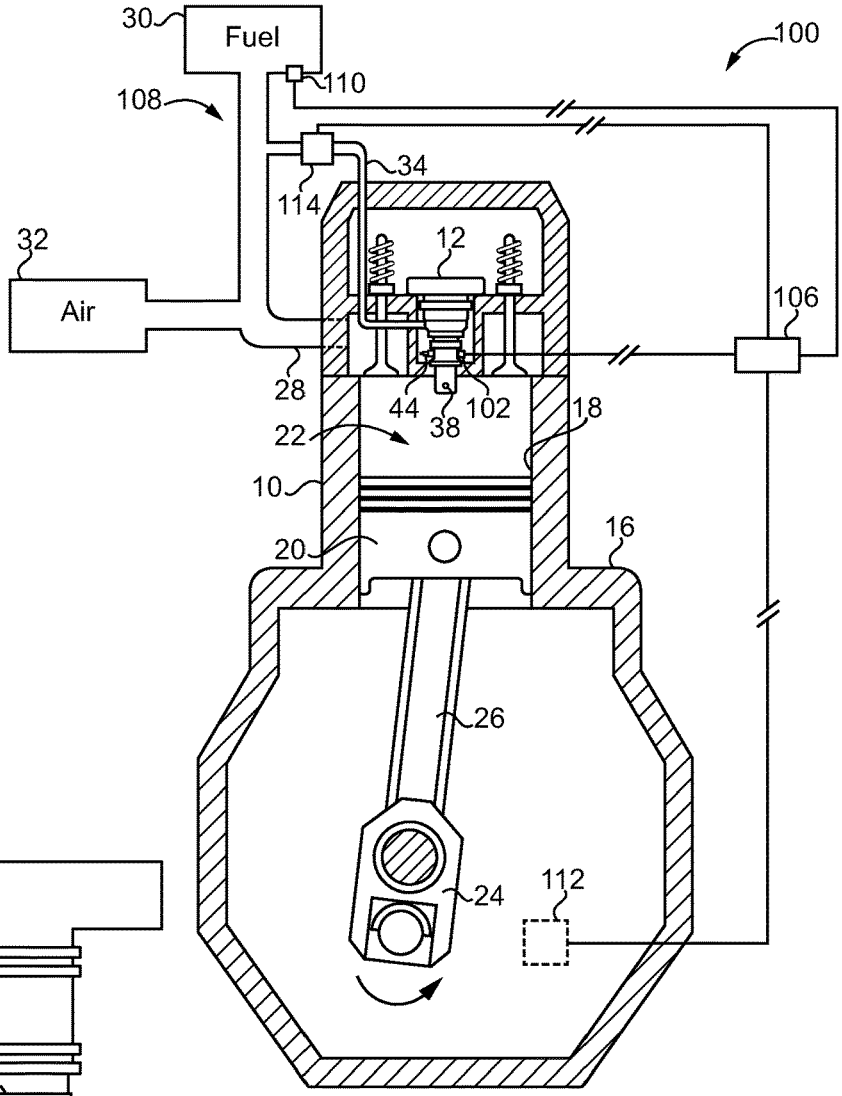
FIG. 1 is a partially sectioned side diagrammatic view of an engine having an ignition control system, according to one embodiment.
Figure 2:
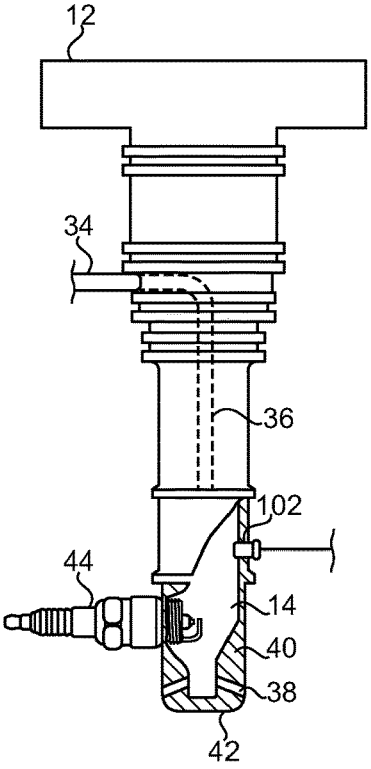
FIG. 2 is a diagrammatic view, in partial cutaway, of a portion of an ignition control system for a prechamber, according to one embodiment.

Referring now to FIG. 1, a partially sectioned view of an internal combustion engine (hereinafter "engine") 10 having a prechamber ignition device (hereinafter "prechamber device") 12 is shown. Engine 10 includes an ignition control system 100 structured to monitor and adjust an air-fuel ratio (AFR) within an auxiliary combustion chamber (hereinafter "prechamber") 14 (as illustrated in FIG. 2, discussed hereinafter) of prechamber device 12. Engine 10 is an exemplary engine in which embodiments of the present disclosure may be implemented. Engine 10 may be a four-stroke, gaseous-fueled engine, though one skilled in the art will recognize that the present disclosure is not thusly limited and may be implemented in any prechamber-ignited combustion engine. Engine 10 may include an engine housing or block 16 having a cylinder 18 therein, and a piston 20 within cylinder 18. Piston 20 and cylinder 18 define a primary combustion chamber (hereinafter "combustion chamber") shown at reference numeral 22. Engine 10 may include any number of cylinders 18 and pistons 20 disposed in any suitable configuration, such as an "in-line" or "V" configuration. Piston 20 may be coupled to a crankshaft 24 by a connecting rod 26 such that reciprocation of piston 20 between a top-dead-center (TDC) position and a bottom-dead-center (BDC) position drives rotation of crankshaft 24.

An intake line 28 may fluidly couple engine 10 to a fuel source 30 and/or an air source 32 to convey at least one of air, fuel, or an air-fuel mixture to combustion chamber 22. Fuel may be conveyed to prechamber device 12 by a fuel delivery line 34 fluidly coupling fuel source 30 and prechamber device 12. Referring now also to FIG. 2, a cutaway view of prechamber device 12 is shown. Fuel delivery line 34 may be coupled to a fuel passage 36 formed within prechamber device 12 and extending to prechamber 14, with fuel passage 36 structured to deliver fuel or potentially a mixture of fuel and air from fuel delivery line 34 to prechamber 14. Fuel source 30 may contain any gaseous fuel such as natural gas, biogas, methane, landfill gas, propane, or the like, stored in a compressed gaseous state or as a cryogenic liquid. In some embodiments, engine 10 may include two or more fuel sources, which may contain multiple types of fuel. Air source 32 may include, for example, an ambient air intake or a compressor outlet in a turbocharger. In some embodiments, engine 10 may include an exhaust gas recirculation (EGR) system (not shown) structured to direct exhaust to intake line 28, for example, for mixing with fuel and air in combustion chamber 22 and/or prechamber 14.

Prechamber device 12 may be positioned in engine 10 such that prechamber 14 is at least partially within combustion chamber 22. Prechamber device 12 may include one or more ignition outlets 38 formed in a prechamber wall 40, with ignition outlets 38 extending between prechamber 14 and an outer surface 42 of prechamber device 12. Ignition outlets 38 may be structured to fluidly couple prechamber 14 with combustion chamber 22. Prechamber device 12 also includes a spark ignition device 44 coupled with prechamber device 12, such as a sparkplug having a spark gap, for igniting a charge of air and fuel in prechamber 14. Combustion of the charge of air and fuel creates combustion gases that expand rapidly and exit to combustion chamber 22 through ignition outlets 38. Hot combustion gases escaping prechamber 14 then ignite an air-fuel mixture in combustion chamber 22. The resulting combustion reaction results in rapid expansion of combustion gases that urge piston 20 towards the BDC position.

Ignition outlets 38 may also serve as an air intake for prechamber 14. Movement of piston 20 from the BDC position to the TDC position reduces the volume of combustion chamber 22 to cause an amount of air and/or an amount of an air-fuel mixture, or air mixed with one or both of fuel or exhaust, to pass through ignition outlets 38 into prechamber 14. The gases conveyed to prechamber 14 mix with fuel delivered to prechamber device 12.

Engine 10 further includes ignition control system (hereinafter "system") 100 structured to control prechamber stoichiometry by determining an AFR of the prechamber, and commanding varying delivery of fuel or other material to prechamber 14 to vary the AFR by adjusting towards a target AFR. The target AFR may be a mixture of air and fuel or other mixture having a stoichiometric balance that has been determined to facilitate combustion according to desired combustion properties in prechamber 14. The target AFR could vary based on any number of considerations such as engine configuration or fuel type, or reflect extrinsic factors like performance optimization or regulatory compliance, among other things. It has been observed that relative precise and accurate knowledge of and control over prechamber AFR assists in achieving precise and accurate control over ignition timing in a prechamber and thus ignition timing in a main combustion chamber, while optimizing the contribution of the prechamber to the engine's emissions profile. As such, when the actual or apparent AFR diverges from the target AFR, falls outside a target AFR range, or otherwise exceeds a tolerable variance from the target AFR, undesired consequences may follow.

System 100 may include one or more components acting in concert to regulate delivery of fuel, air, or other materials, to prechamber 14 responsive to one or more operating conditions and/or operating parameters of engine 10 or prechamber 14. The components may include, among other things, a prechamber sensor 102, an electronic control unit (ECU) 106, a fuel supply system 108 structured to deliver a fuel to prechamber 14, a fuel quality sensor 110, and an engine timing sensor 112. Each of prechamber sensor 102, fuel supply system 108, fuel quality sensor 110, and engine timing sensor 112 may be communicatively coupled to ECU 106 in a manner that allows each to send a signal encoding data indicative of the parameter of interest to ECU 106, or be interrogated by ECU 106 to produce the subject data. ECU 106 may be structured to control the AFR in prechamber 14 based at least in part on data received by prechamber sensor 102 and engine timing sensor 112. In some embodiments, system 100 may include additional and/or alternative components for measuring, monitoring, or sensing, one or more engine, prechamber, atmospheric, and/or other conditions or operating parameters, or for commanding, controlling, or otherwise varying delivery or conveyance of fuel, air, exhaust, or other materials to or from prechamber 14.

Prechamber sensor 102 may be configured to measure or sample a condition of prechamber 14 indicative of the actual AFR. It has been discovered that an amount of $CO_2$ or $O_2$ may correspond with a prior prechamber AFR that produced that amount of $CO_2$ or $O_2$, wherein "amount" may include a concentration, a volume, a mass, a molar mass, or the like. For example, a residual amount of $CO_2$ and $O_2$ after a combustion event may correspond with the prechamber AFR at the time of that combustion event. As such, prechamber sensor 102 may be structured to measure at least one of $CO_2$ or $O_2$ in prechamber 14 of prechamber device 12, and may include, for instance, a $CO_2$ sensor and/or an $O_2$ sensor, such as a nondispersive infrared (NDIR) sensor or a chemical gas sensor. A stoichiometrically balanced charge of a hydrocarbon (HC) and air, which is comprised primarily of $O_2$ and $N_2$, will theoretically see both the $O_2$ and the HC consumed substantially entirely, resulting in emissions of $H_2O$, $CO_2$, plus molecular nitrogen and/or nitrogen compounds. An $O_2$ sensor configured to detect a residual amount of $O_2$ present after combustion can produce data that allows the amount of air combusted with fuel to produce that residual $O_2$ to be backed out. Analogously, a $CO_2$ sensor configured to detect a residual amount of $CO_2$ present after combustion can produce data that allows the amount of fuel combusted with air to produce that amount to be backed out. System 100 might include both a $CO_2$ sensor and an $O_2$ sensor, or may include one or more different types of sensors structured to measure another prechamber condition indicative of the parameter of interest. Prechamber sensor 102 may be situated within prechamber 14 as seen in FIG. 2, or may otherwise be in fluid communication with the air-fuel mixture within prechamber 14.

Figure 3:
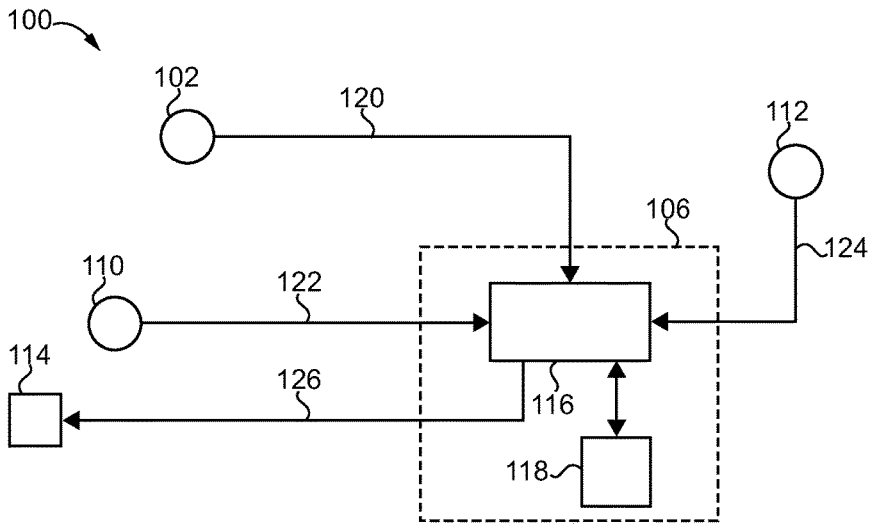
FIG. 3 is a block diagram of an ignition control system for a prechamber, according to one embodiment.

ECU 106 of the present embodiment may also include a processor 116 (as illustrated in FIG. 3, discussed hereinafter) as mentioned above, or series of processors, structured to perform calculations, execute instructions, communicate with other components of system 100 by, for example, sending or receiving signals, and/or perform other functions designed to facilitate control of system 100. Processor 116 might include a microprocessor or a field programmable gate array (FPGA), for example. ECU 106 may also include a memory 118 (as illustrated in FIG. 3, discussed hereinafter) communicatively coupled with processor 116 and structured to store data and/or computer-executable instructions. Memory 118 could include RAM, ROM, DRAM, SDRAM, Flash, or still another type of memory. ECU 106 may be a standalone unit structured for and dedicated to regulating prechamber stoichiometry. In some embodiments, ECU 106 may be structured to perform other functions, or may be integrally formed with an engine control unit of engine 10.

System 100 may also include fuel supply system 108 as noted above, which may be integrally formed with air and fuel delivery equipment structured to deliver air and fuel to combustion chamber 22, wherein fuel supply system 108 includes fuel source 30 having supply of gaseous fuel, fuel delivery line 34, and a valve 114 disposed between fuel source 30 and fuel delivery line 34. In other embodiments, fuel supply system 108 may be discrete from the air and fuel systems for combustion chamber 22. In some embodiments, fuel supply system 108 may include a fuel different than the fuel provided by a main combustion chamber supply system such as a more readily ignited fuel. In still other embodiments, fuel supply system 108 may include air intake or compressed air supply components. It will also be appreciated that supplying of air to prechamber device 12 could be controlled to enable manipulating prechamber AFR in accordance with the present disclosure.

Fuel quality sensor 110 may be structured to measure a fuel parameter indicative of a ration of hydrogen to carbon in fuel supplied to prechamber 14. For example, fuel quality sensor 110 may be structured to monitor a property of the fuel, such as heat capacity, that corresponds with a fuel parameter indicative of fuel quality, such as Lower Heating Value (LHV), Wobbe Index (WI), Specific Gravity (Sg), Methane Number (MN), or Specific Heat Ratio ($\gamma$). In alternative embodiments, any other type of sensor structured to measure, estimate, or infer, directly or indirectly, a ratio of hydrogen to carbon in fuel, or one or more sensors structured to measure or detect the presence of hydrogen or carbon individually, may be used instead of or in addition to fuel quality sensor 110. Fuel quality sensor 110 may be situated within fuel source 30 of fuel supply system 108, although, in alternative embodiments, fuel quality sensor 110 may be situated in a different location, such as in fuel delivery line 34. As discussed below, in some instances no fuel quality sensor is used at all.

System 100 may also include engine timing sensor 112 for producing data indicative of engine timing. Combustion engine operation is cyclical in nature, and therefore determining an engine timing that is associated with the CO2 or O2 measurements enables the data of CO2 or O2 amount to be associated with a particular timing in the engine cycle. Since in-cylinder pressure variation can be expected to potentially affect CO2 or O2 amount that is observed, information as to the crank angle at which a particular measurement is made allows the measurement to be normalized, compensated, or otherwise calibrated. One engine cycle in a 4-stroke engine includes 720 degrees of rotation by crankshaft 24. Engine timing sensor 112 of the present embodiment includes a crank angle sensor (hereinafter "crank angle sensor 112") structured to measure a crank angle of crankshaft 24. In other embodiments, alternative sensors suitable for measuring engine timing, such as a piston position sensor or potentially even a pressure or a temperature sensor positioned in combustion chamber 22, for example, might be used.

INDUSTRIAL APPLICABILITY

As discussed previously, it has been observed that variations in prechamber stoichiometry may impact engine performance. Combustion of the air-fuel mixture in combustion chamber 22 is dependent for ignition upon an immediately preceding ignition and combustion of an air-fuel mixture in prechamber 14. It has been found that even if engine operating conditions are relatively consistent, actual prechamber AFR may still vary. Some of this variability may be due to inconsistent volumes and/or compositions of air or in-cylinder mixtures being supplied to prechamber 14 from combustion chamber 22. Prechamber AFR variability can also result from variability in fuel admission valve operation and variations in fuel quality. Some known systems that involve variable adjustment of delivery of fuel or other materials to a prechamber are tied to particular engine configurations and/or fuel types to determine a prechamber condition that may provide a measurable estimate of prechamber AFR. Adjustments in fuel delivery to the prechamber in these systems may not directly correspond with changes in the prechamber condition being monitored, and require further calculation to calibrate responsive to a type of fuel being delivered. While these strategies may be somewhat effective for reducing NOx emissions or achieving other aims over the course of many engine cycles, such strategies may be inefficient in reducing cycle-to-cycle variability in prechamber AFR.

The present disclosure may be deployed in any internal combustion engine having an auxiliary combustion chamber structured to convey combustion gases to a primary chamber for ignition. Determining the actual AFR through use of CO2 or O2 sampling may allow for direct, real-time monitoring of prechamber AFR and adjustment to prechamber stoichiometry in response.

The present disclosure may adjust stoichiometry of prechamber 14 in engine 10 by producing data indicative of an amount of at least one of CO2 or O2 produced by combustion of a first charge of air and fuel in prechamber 14, outputting a fuel delivery signal 126 to vary an amount of fuel delivered to prechamber 14 after combustion of the first charge of air and fuel, and igniting a second charge of fuel and air in prechamber 14 that has an amount of fuel that is based on fuel delivery signal 126. Producing the data may include producing the data by way of measuring the amount of at least one of CO2 or O2 of the first charge of air and fuel in prechamber 14 using a sensor positioned at least partially within prechamber 14. Adjustment of prechamber stoichiometry may further include determining an AFR from the data indicative of an amount of at least one of CO2 or O2 and data indicative of fuel quality and/or comparing the determined AFR with a target AFR and responsively generating fuel delivery signal 126, outputting an engine timing signal 124 wherein determination of the AFR is responsive to engine timing signal 124. Fuel may include a gaseous fuel, and adjusting prechamber stoichiometry may further include spark-igniting each of the first charge of fuel and air and the second charge of fuel and air within prechamber 14.

ECU 106 may be structured to receive data indicative of an amount of the at least one of CO2 or O2, to determine an AFR in prechamber 14 associated with production of the amount of the at least one of CO2 or O2, and output fuel delivery signal 126 to adjust AFR in prechamber 14 towards a target AFR. ECU 106 may be further structured to determine the AFR based on a fuel parameter, to determine a control command for valve 114 in fuel supply system 108 of system 100 based on fuel delivery signal 126, and/or to compare the determined AFR with a target AFR and generate fuel delivery signal 126 based on a difference between the determined AFR and the target AFR, wherein the determination of the AFR may be reflective of engine timing. In some embodiments, ECU 106 may be structured to determine the AFR in prechamber 14 in an earlier engine cycle, and generate fuel delivery signal 126 to adjust the AFR for a later engine cycle. Referring now also to FIG. 3, a block diagram of components and signals in system 100 is illustrated. Prechamber sensor 102 may be structured to sample a prechamber condition, such as a residual amount of CO2 or O2 after combustion, and generate a prechamber signal 120, which is indicative of the prechamber condition. Fuel quality sensor 110 may be structured to measure fuel quality of the fuel to be delivered to prechamber 14 and generate a fuel quality signal 122 that is indicative thereof, and crank angle sensor 112 may measure and generate engine timing signal 124 indicative of the crank angle of crankshaft 24. ECU 106 produces fuel delivery signal 126.

Figure 4:
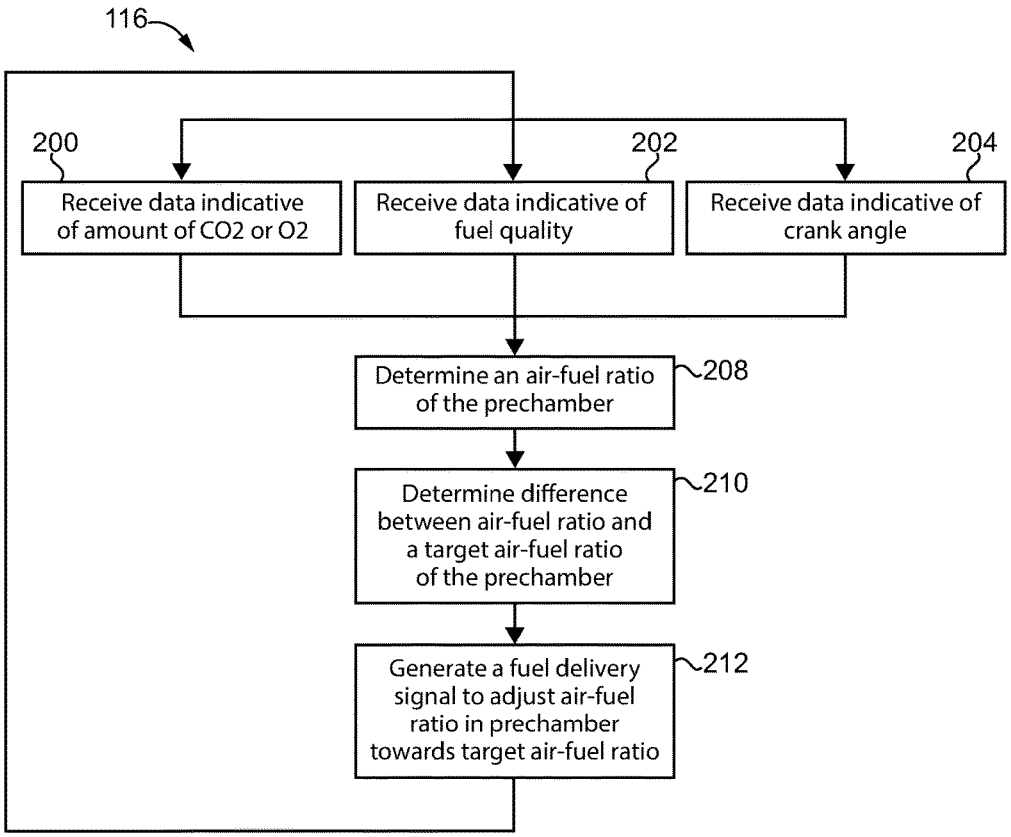
FIG. 4 is flowchart illustrating example process and control logic, according to one embodiment.

Referring now also to FIG. 4, a flowchart illustrating process and control logic flow to determine a fuel delivery signal to adjust AFR towards a target AFR is shown. Target AFR may be a stoichiometric balance of air and fuel, however, in some instances the target AFR could be relatively richer or relatively leaner than stoichiometric. Fuel delivery signal 126 may include a control signal for commanding valve 114 in system 100 to vary delivery of fuel to prechamber 14 to produce the target AFR. Valve 114 may be electronically actuated, and structured to vary fuel delivery to prechamber 14 by, for example, varying the time valve 114 is opened, or varying a valve opening amount, or both. Processor 116 may be structured to receive signals 120, 122, 124 generated by sensors 102, 110, 112, respectively, encoding data indicative of a condition of prechamber 14 or engine 10. In FIG. 4, processor 116 may receive data indicative of an amount of CO2 or O2 at block 200, data indicative of a crank angle at block 204, and data indicative of fuel quality at block 202. In some embodiments, a hydrogen-carbon ratio for one or more fuels used in fuel supply system 108 may be stored in memory 118 such that processor 116 may access memory 118 to retrieve a hydrogen-carbon ratio or other fuel quality data instead of detecting it through use of a sensor or other means if, for instance, only a single fuel is to be delivered to the prechamber and/or fuel quality is otherwise known and consistent.

Processor 116 may be structured to use data indicative of CO2 or O2 and fuel quality data to calculate the actual or apparent AFR in a preceding, earlier combustion reaction in prechamber 14. Further, processor 116 may link the data indicative of an amount of CO2 or O2 with the data indicative of crank angle or otherwise of engine timing so as to account for a relative pressure of prechamber gases affecting the amount of CO2 or O2. Processor 116 may then determine an AFR of the prechamber at block 208 and compare the determined AFR with a target AFR of the prechamber at block 210. Processor 116 may then determine a target amount of fuel (or analogously air in a system that varies air delivery) that, if delivered to prechamber 14, adjusts the actual AFR to the target AFR in a later engine cycle. As discussed herein the fuel quality data may be used in the calculation of the target amount of fuel. Processor 116 then generates the fuel delivery signal to adjust the AFR at block 212. Fuel delivery signal 126 may include a command such as an electrical current valve actuation command to vary the amount of fuel, cycle-to-cycle, supplied to fuel delivery line 34 to produce the desired AFR of prechamber 14 or adjust the actual AFR toward the target AFR. For example, if processor 116 determines that the actual AFR is lean, fuel delivery signal 126 may command valve 114 to remain open for a longer duration than a prior open time in order to allow more fuel to be delivered to prechamber 14. Valve 114 may be disposed within fuel supply system 108 in a manner configured to control an amount of fuel delivered to prechamber 14 responsive to fuel delivery signal 126. Conversely, if processor 116 determines the AFR is rich, fuel delivery signal 126 may command valve 114 to remain open for a shorter amount of time than the prior time. The logic can then loop back to continue control of prechamber AFR in a closed loop fashion.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. It will be appreciated that certain features and/or properties of the present disclosure, such as relative dimensions or angles, may not be shown to scale. As noted above, the teachings set forth herein are applicable to a variety of different engines having a variety of different structures than those specifically described herein. Other aspects, features and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

What is claimed is:

1. An ignition control system for an internal combustion engine comprising:

a sensor structured to measure at least one of CO2 or O2 in a combustion prechamber of a prechamber ignition device; and an electronic control unit structured to:

receive data indicative of a residual amount of the at least one of CO2 or O2 produced by combustion of fuel and air in the combustion prechamber;

determine an air-fuel ratio in the combustion prechamber associated with production of the amount of the at least one of CO2 or O2; and output a fuel delivery signal to adjust air-fuel ratio in the combustion prechamber towards a target air-fuel ratio.

2. The system of claim 1 further including a fuel quality sensor structured to measure a fuel parameter indicative of a ratio of hydrogen to carbon in a fuel supplied to the combustion prechamber.

3. The system of claim 1 wherein the electronic control unit is further structured to determine the air-fuel ratio based on the fuel parameter.

4. The system of claim 1 wherein the electronic control unit is further structured to determine a control command for a valve in a fuel supply system of the ignition control system based on the fuel delivery signal.

5. The system of claim 1 wherein the electronic control unit is further structured to compare the determined air-fuel ratio with a target air-fuel ratio, and generate the fuel delivery signal based on a difference between the determined air-fuel ratio and the target air-fuel ratio.

6. The system of claim 5 further including an engine timing sensor, wherein the determination of the air-fuel ratio is reflective of engine timing.

7. The system of claim 5 further comprising a prechamber ignition device having a combustion prechamber, and a spark ignition device coupled with the prechamber ignition device.

8. The system of claim 7 wherein the fuel supply system includes a supply of gaseous fuel.

9. The system of claim 1 wherein the electronic control unit is structured to determine the air-fuel ratio in the prechamber in an earlier engine cycle, and generate the fuel delivery signal to adjust the air-fuel ratio for a later engine cycle.

10. A method of adjusting stoichiometry of a combustion prechamber in an internal combustion engine comprising:

producing data indicative of an amount of at least one of CO2 or O2 produced by combustion of a first charge of air and fuel in a combustion prechamber;

outputting a fuel delivery signal to vary an amount of fuel delivered to the combustion prechamber after the combustion of the first charge of air and fuel; and igniting a second charge of fuel and air in the combustion prechamber that has an amount of fuel that is based on the fuel delivery signal.

11. The method of claim 10 wherein the producing of the data includes producing the data by way of measuring the amount of at least one of CO2 or O2 of the first charge of air and fuel in the combustion prechamber using a sensor positioned at least partially within the combustion prechamber.

12. The method of claim 10 further comprising determining an air-fuel ratio from the data indicative of an amount of at least one of CO2 or O2 and data indicative of fuel quality.

13. The method of claim 12 further comprising comparing the determined air-fuel ratio with a target air-fuel ratio, and responsively generating the fuel delivery signal.

14. The method of claim 13 further comprising outputting an engine timing signal and wherein determination of the air-fuel ratio is responsive to the engine timing signal.

15. The method of claim 14 wherein the fuel includes a gaseous fuel, and further comprising spark-igniting each of the first charge of fuel and air and the second charge of fuel and air within the combustion prechamber.

16. An internal combustion engine comprising:

an engine block;

a cylinder formed in the engine block;

a piston disposed in the cylinder and movable between a top-dead-center (TDC) position and a bottom-dead-center (BDC) position, the piston and the cylinder defining a combustion chamber;

a prechamber ignition device having a combustion prechamber, and one or more ignition outlets fluidly connecting the combustion prechamber to the main combustion chamber at each of the BDC position and the TDC position; and an ignition control system including a prechamber sensor structured to measure at least one of residual CO2 or O2 in the combustion prechamber produced by combustion of fuel and air in the combustion prechamber, an engine timing sensor, a fuel supply system structured to deliver a fuel to the combustion prechamber, and an electronic control unit; and the electronic control unit being structured to control an air-fuel ratio in the combustion prechamber based on the measured at least one of residual CO2 or O2 and an engine timing indicated by the engine timing sensor.

17. The engine of claim 16 wherein the fuel supply system includes a fuel source, a fuel delivery line, and a valve disposed between the fuel source and the fuel delivery line.

18. The engine of claim 16 wherein the electronic control unit is structured to generate a fuel delivery signal to command the valve to deliver an amount of fuel to the combustion prechamber that adjusts the air-fuel ratio towards a target air-fuel ratio.

19. The engine of claim 16 wherein the fuel supply system includes a gaseous fuel supply system, and the engine further including an ignition device coupled to the combustion prechamber.

* * * * *